US010898408B2

(12) United States Patent
Merrill et al.

(10) Patent No.: US 10,898,408 B2
(45) Date of Patent: Jan. 26, 2021

(54) FASCIAL MOBILITY TOOL

(71) Applicant: Coulter Ventures LLC, Columbus, OH (US)

(72) Inventors: Charles Scott Merrill, Boulder, CO (US); Dylan Jones, Santa Barbara, CA (US)

(73) Assignee: Coulter Ventures, LLC., Columbus, OH (US)

( * ) Notice: Subject to any disclaimer, the term of this patent is extended or adjusted under 35 U.S.C. 154(b) by 141 days.

(21) Appl. No.: 15/917,343

(22) Filed: Mar. 9, 2018

(65) Prior Publication Data

US 2019/0015288 A1 Jan. 17, 2019

Related U.S. Application Data

(60) Provisional application No. 62/469,420, filed on Mar. 9, 2017.

(51) Int. Cl.
*A61H 7/00* (2006.01)
*A61H 1/00* (2006.01)

(52) U.S. Cl.
CPC ..... *A61H 7/003* (2013.01); *A61H 1/00* (2013.01); *A61H 7/00* (2013.01); *A61H 7/001* (2013.01);
(Continued)

(58) Field of Classification Search
CPC . A61H 1/00; A61H 1/008; A61H 7/00; A61H 7/003; A61H 7/001; A61H 7/007;
(Continued)

(56) References Cited

U.S. PATENT DOCUMENTS

D21,551 S * 5/1892 Young ..... D24/135
1,516,464 A * 11/1924 Taplin ..... A61H 1/008 606/237

(Continued)

OTHER PUBLICATIONS

Hudacek, Laura, "How to Optimize Adhesion in Hard-Soft Overmolding" Feb. 1, 2004 https://www.ptonline.com/articles/articles/how-to-optimize-adhesion-in-hard-soft-overmolding (Year: 2004).*

(Continued)

*Primary Examiner* — Valerie L Woodward
*Assistant Examiner* — Paige Kathleen Bugg
(74) *Attorney, Agent, or Firm* — Banner & Witcoff, Ltd.

(57) ABSTRACT

A mobility tool includes a body having first and second opposed ends and an outer surface, and a connection structure at the first end of the body, where the connection structure is configured for connection to a mounting structure. The outer surface of the body includes a top surface, a bottom surface, and side surfaces extending between the first and second ends, where the top and bottom surfaces have greater surface area than the side surfaces. The bottom surface has a contour that includes a convex portion proximate the first end and a concave portion proximate the second end. The height of the body is greater at the convex portion than the concave portion and smallest at the second end. The body further includes an inner body formed of a rigid material, and an outer body at least partially covering the inner body and formed of a flexible material having greater flexibility than the rigid material.

27 Claims, 5 Drawing Sheets

(52) U.S. Cl.
CPC ..... *A61H 7/007* (2013.01); *A61H 2201/0107* (2013.01); *A61H 2201/0126* (2013.01); *A61H 2201/0157* (2013.01); *A61H 2201/1284* (2013.01); *A61H 2201/1645* (2013.01); *A61H 2201/1692* (2013.01)

(58) Field of Classification Search
CPC ..... A61H 7/002; A61H 7/004; A61H 7/005; A61H 99/00; A61H 2201/0107; A61H 2201/0126; A61H 2201/0157; A61H 2201/1284; A61H 2201/1645; A61H 2201/1692; A61H 2201/01; A61H 2201/0119; A61H 2201/0138; A61H 2201/1253; A61H 2201/1261; A61H 2201/1269; A61H 2201/16; A61H 2201/1638; A61H 2201/168; A61H 2201/1683; A61H 2201/169; A61H 2201/1695; A61H 2201/1685; A61H 2201/1688; A61H 2201/1697; A61H 2203/04; A61H 2203/0406; A61H 39/04; A61H 39/00; A61H 39/007; A61H 2023/002
USPC ..... 601/137; D24/214, 215
See application file for complete search history.

(56) References Cited

U.S. PATENT DOCUMENTS 1,723,024 A * 8/1929 Fisher ..... A61H 7/003 601/137
1,769,872 A * 7/1930 Weeks ..... A61H 7/003 601/17
D85,076 S * 9/1931 Barker ..... D24/214
1,833,105 A * 11/1931 Aronson ..... A61H 7/003 601/15
D113,159 S * 1/1939 De Filippis ..... D24/214
2,929,374 A * 3/1960 O'Gara ..... A61H 7/003 601/15
D208,608 S * 9/1967 Madl et al. ..... D24/214
D209,643 S * 12/1967 Mozneck ..... D24/206
3,382,866 A * 5/1968 Harris ..... A61F 7/02 601/19
3,512,328 A * 5/1970 Eriksson ..... F16B 5/01 52/787.1
D242,390 S * 11/1976 Grube ..... D24/215
3,994,289 A * 11/1976 Thomas ..... A61H 39/04 601/120
D247,312 S * 2/1978 Zeiss ..... D24/215
4,483,328 A * 11/1984 Wolocko ..... A61H 1/008 601/135
4,520,798 A * 6/1985 Lewis ..... A61H 39/04 601/134
5,016,617 A * 5/1991 Tarlow ..... A61H 7/004 601/101
D326,327 S * 5/1992 Sue ..... D24/200
5,170,778 A * 12/1992 Jamis ..... A61H 15/00 601/121
D338,964 S * 8/1993 Tarjoto ..... A61H 7/00 D24/200
D345,801 S * 4/1994 Bosch ..... D24/200
D357,323 S * 4/1995 Leonard ..... D24/214
5,470,303 A * 11/1995 Leonard ..... A61H 19/34 600/38
D373,197 S * 8/1996 Schepper ..... D24/214
D386,879 S * 11/1997 Daniels ..... D24/214
5,810,875 A * 9/1998 Meilus ..... A61H 1/008 606/204
5,817,037 A * 10/1998 Zurbay ..... A61H 7/003 601/135
5,843,005 A * 12/1998 Chubinsky ..... A61H 7/003 601/15
5,848,980 A * 12/1998 Demerais ..... A61H 23/02 601/46
5,904,661 A * 5/1999 Bonz ..... A61H 7/005 601/101
6,105,182 A * 8/2000 Elnar ..... A61H 7/00 248/125.3
6,254,555 B1 * 7/2001 Sevier ..... A61H 7/001 601/134
6,830,532 B1 * 12/2004 Gebby ..... B60K 5/08 477/107
6,837,860 B1 * 1/2005 Auletta ..... A61H 7/004 601/112
6,887,211 B1 * 5/2005 Sevier ..... A61H 7/001 601/135
D518,576 S * 4/2006 Sevier ..... D24/200
D530,429 S * 10/2006 Sevier ..... D24/214
D530,823 S * 10/2006 Sevier ..... D24/214
7,431,706 B2 * 10/2008 Louis ..... A61H 7/001 601/135
D590,066 S * 4/2009 Stewart ..... D24/214
D596,307 S * 7/2009 Stewart ..... D24/214
D638,549 S * 5/2011 Scappaticci ..... D24/214
D645,569 S * 9/2011 Nitsch ..... D24/215
D676,566 S * 2/2013 Tucker ..... D24/214
D677,394 S * 3/2013 Grust ..... D24/215
D678,539 S * 3/2013 Narson ..... D24/200
D686,333 S * 7/2013 Innes ..... D24/215
D687,957 S * 8/2013 Heskier ..... D24/215
D692,570 S * 10/2013 Luzon ..... D24/215
D696,414 S * 12/2013 Tabe ..... D24/215
D697,629 S * 1/2014 Kim ..... D24/211
D701,613 S * 3/2014 Twiggs ..... D24/215
D706,445 S * 6/2014 Logan ..... D24/215
D707,842 S * 6/2014 Li ..... D24/215
D712,056 S * 8/2014 Deramo ..... D24/215
8,801,642 B1 * 8/2014 Slominski ..... A61H 7/001 601/135
D716,465 S * 10/2014 Kanbar ..... A61H 19/40 D24/215
9,132,055 B1 * 9/2015 Wallace ..... A61H 23/0263
D752,238 S * 3/2016 Stock ..... D24/214
D752,239 S * 3/2016 Stock ..... D24/214
D754,869 S * 4/2016 Stock ..... D24/214
D767,780 S * 9/2016 Pursel ..... D24/214
D788,934 S * 6/2017 Hirokawa ..... D24/215
D809,151 S * 1/2018 Li ..... D24/215
9,925,110 B1 * 3/2018 Lang ..... A61H 7/00
D825,770 S * 8/2018 Siemer ..... D24/211
D828,926 S * 9/2018 Stock ..... D24/214
D833,636 S * 11/2018 Lai ..... D24/214
D850,642 S * 6/2019 Yokoyama ..... D24/215
10,314,762 B1 * 6/2019 Marton ..... A61H 23/006
D857,223 S * 8/2019 Nagata ..... D24/215
D861,182 S * 9/2019 Wersland ..... D24/211
D861,829 S * 10/2019 Wang ..... D23/215
D863,585 S * 10/2019 Weitzner ..... D24/214
D878,615 S * 3/2020 Ankosko ..... D24/200
D879,980 S * 3/2020 Johnston ..... D24/200
2001/0051778 A1 * 12/2001 Sevier ..... A61H 7/001 601/137
2002/0072692 A1 * 6/2002 Batula ..... A61H 23/06 601/84
2002/0107460 A1 * 8/2002 Scheele ..... A61H 7/001 601/135
2002/0183661 A1 * 12/2002 Yoo ..... A61H 39/04 601/23
2002/0193714 A1 * 12/2002 Pecora ..... A61H 15/00 601/121
2004/0230139 A1 * 11/2004 Chang ..... A43B 1/0054 601/15
2006/0142675 A1 * 6/2006 Sargent ..... A61H 39/04 601/70
2007/0287940 A1 * 12/2007 Sabo ..... A61H 7/005 601/137
2008/0086066 A1 * 4/2008 Munday ..... A61H 39/04 601/135

(56) References Cited

U.S. PATENT DOCUMENTS

2008/0097262 A1* 4/2008 Adams ..... A61H 7/001 601/134
2008/0139981 A1* 6/2008 Walquist ..... A61H 7/001 601/134
2009/0177210 A1* 7/2009 Durso ..... A61H 7/003 606/133
2010/0004574 A1* 1/2010 Chen ..... A61H 7/004 601/134
2010/0036298 A1* 2/2010 Fuster ..... A61H 7/008 601/133
2010/0145244 A1* 6/2010 Schwartz ..... A61H 39/04 601/134
2011/0218465 A1* 9/2011 Yang ..... A61H 1/00 601/18
2012/0028765 A1* 2/2012 Morin ..... A63B 23/1218 482/91
2012/0158040 A1* 6/2012 Dehors ..... A61H 7/003 606/201
2012/0209363 A1* 8/2012 Williams, III ..... A61F 7/02 607/114
2012/0232446 A1* 9/2012 Ormsbee D.C., Dabco ..... A61H 7/001 601/134
2012/0310125 A1* 12/2012 Hall ..... A61H 39/04 601/120
2012/0323151 A1* 12/2012 Faussett ..... A61H 15/0092 601/119
2013/0030464 A1* 1/2013 Taguchi ..... A61F 5/01 606/238
2013/0165827 A1* 6/2013 Liu ..... A61H 99/00 601/137
2013/0197405 A1* 8/2013 Williams, III ..... A61F 7/02 601/19
2013/0296750 A1* 11/2013 Pursel ..... A61H 99/00 601/137
2014/0005581 A1* 1/2014 Scappaticci ..... A61H 7/003 601/138
2014/0336549 A1* 11/2014 Yang ..... A61H 7/007 601/112
2015/0148592 A1* 5/2015 Kanbar ..... A61H 19/34 600/38
2015/0150749 A1* 6/2015 Deramo ..... A61H 7/007 601/135
2015/0231016 A1* 8/2015 Stearns ..... A61H 7/001 601/136
2015/0328080 A1* 11/2015 Ryan ..... A61H 15/00 601/128
2015/0351996 A1* 12/2015 Bukharina ..... A61H 7/001 601/134
2016/0058656 A1* 3/2016 Harvel ..... A61H 15/0092 601/122
2016/0317386 A1* 11/2016 Suttman ..... A61H 7/001
2016/0317387 A1* 11/2016 Cox ..... A61H 39/04
2016/0324711 A1* 11/2016 Richmond ..... A61H 1/0292
2016/0324717 A1* 11/2016 Burton ..... A61H 7/001
2016/0361223 A1* 12/2016 Muller ..... A61H 7/002
2016/0367015 A1* 12/2016 Hung ..... A61H 7/005
2016/0367425 A1* 12/2016 Wersland ..... A61H 1/00
2017/0135892 A1* 5/2017 McConnell ..... A61H 1/008
2017/0202723 A1* 7/2017 Serola ..... A61H 1/008
2017/0216133 A1* 8/2017 Yih ..... A61H 15/0092
2017/0216136 A1* 8/2017 Gordon ..... A61H 15/0092
2017/0231851 A1* 8/2017 Faussett ..... A61H 15/00 601/135
2017/0266794 A1* 9/2017 Hettich ..... B25B 27/143
2017/0273850 A1* 9/2017 Wise ..... A61H 7/001
2018/0103808 A1* 4/2018 Cheong ..... A61H 15/00
2018/0142832 A1* 5/2018 Inouye ..... A61H 15/00
2019/0008716 A1* 1/2019 Giddings ..... A61H 7/007
2019/0017528 A1* 1/2019 Wersland ..... F16B 21/186
2019/0029916 A1* 1/2019 Ennis ..... A61H 1/00
2019/0350793 A1* 11/2019 Wersland ..... A61H 23/006
2019/0388295 A1* 12/2019 Lim ..... A61H 15/00
2020/0078266 A1* 3/2020 Miller ..... A63B 21/06

OTHER PUBLICATIONS

Star Thermoplastics "Using Hardness Scales with TPEs" https://www.starthermoplastics.com/our-chemistry/shore-hardness-scale/ (Year: 2014).*

Omnexus "Comprehensive Guide on Polyvinyl Chloride (PVC)" https://onnnexus.specialchem.com/selection-guide/polyvinyl-chloride-pvc-plastic#RigidvsFlexible (Year: 2018).*

* cited by examiner

FASCIAL MOBILITY TOOL

CROSS-REFERENCE TO RELATED APPLICATION

This application is a non-provisional of, and claims priority to, U.S. Provisional Application No. 62/469,420, filed Mar. 9, 2017, which prior application is incorporated by reference herein in its entirety.

FIELD OF THE INVENTION

This disclosure relates to mobility tools and similar tools for massage and assisting athletic recovery, rehabilitation, and therapy, and more specifically to a tool of this type that is configured to improve access and treatment of fascia and other tissues that are difficult to engage.

BACKGROUND

Mobility tools are frequently used in various environments to massage, separate, and treat body tissues, including muscles, joints, and connective tissue. Such tools can be used to enhance recovery, rehabilitation, therapy, or comfort, among other purposes. A wide variety of mobility tools currently exist, including various rollers, balls, knobs, bands, and other tools, which may be designed for use by the user alone or with assistance, e.g., by a therapist. However, certain tissues are difficult to access and/or engage with existing mobility tools, particularly when used without assistance. Fascia is one such type of tissue that is often located in areas that are difficult to access with existing mobility tools, or by an unassisted user. Other tissues in various locations present similar difficulties.

The present disclosure is provided to address this need and other needs in existing mobility tools and treatment methods using such tools. A full discussion of the features and advantages of the present invention is deferred to the following detailed description, which proceeds with reference to the accompanying drawings.

BRIEF SUMMARY

Aspects of the disclosure relate to a mobility tool that includes a body having first and second opposed ends and an outer surface, and a connection structure at the first end of the body, where the connection structure is configured for connection to a mounting structure. The outer surface of the body includes a top surface, a bottom surface, and side surfaces extending between the first and second ends, where the top and bottom surfaces have greater surface area than the side surfaces. The bottom surface has a contour that includes a convex portion proximate the first end and a concave portion proximate the second end. The height of the body measured between the top and bottom surfaces is greater at the convex portion than the concave portion, and the height is smallest at the second end. The body further includes an inner body formed of a rigid material, and an outer body formed of a flexible material having greater flexibility than the rigid material. The outer body is disposed to cover the inner body on the top surface, the bottom surface, the side surfaces, and the second end of the body, such that the inner body is exposed only at the first end.

According to one aspect, the mobility tool may also include the mounting structure, which includes a shaft configured to be received through a passage in a support beam to mount the mobility tool on the support beam, with the shaft having a connection end connected to the connection structure of the body. In one configuration, the mounting structure also includes a retaining member configured to retain the shaft within the passage in the support beam. In this configuration, the retaining member may be a cap connected by threading onto the shaft opposite the connection end. The mounting structure may also include a bushing disposed around the shaft and engaging the first end of the body, such that the cap and the bushing are configured to engage opposite sides of the support beam when the mounting structure is connected to the support beam.

According to another aspect, the connection structure includes a threaded bore extending inwardly from the first end of the body. A threaded steel sleeve insert received within the inner body at the first end of the body may be used to define the threaded bore.

Additional aspects of the disclosure relate to a mobility tool that includes a body having first and second opposed ends and an outer surface formed of a flexible material, with the outer surface including a top surface, a bottom surface, and side surfaces extending between the first and second ends, where the top and bottom surfaces have greater surface area than the side surfaces, and with the outer surface having specified contours. The top surface is curved toward the bottom surface, and the bottom surface has a contour that includes an inclined portion more proximate to the first end, a declined portion more proximate the second end, and a concave portion forming a transition between the inclined portion and the declined portion. The height of the body measured between the top and bottom surfaces is greatest at an area of greatest height proximate the first end and decreases from the area of greatest height to the second end, such that the height is smallest at the second end and the body tapers toward the second end.

According to one aspect, the body includes a bulbous portion proximate the first end and a tongue extending from the bulbous portion to the second end, where the concave portion, the declined portion, and at least a portion of the inclined portion are part of the tongue, and wherein the height of the body decreases from the bulbous portion to the second end.

Additional aspects of the disclosure relate to a mobility tool that includes a body having first and second opposed ends and an outer surface including a top surface, a bottom surface, and side surfaces extending between the first and second ends, wherein the body tapers to the second end such that a height of the body measured between the top and bottom surfaces is smallest at the second end. The body further includes an inner body formed of a rigid material having a hardness of 60 to 70 Shore D and an outer body formed of a flexible material having a hardness of 55 to 65 Shore A. The outer body is disposed to cover the inner body on at least a portion of the top surface, at least a portion of the bottom surface, and at least a portion of the side surfaces, the outer body further disposed to cover the inner body on the second end of the body and to form a majority of the outer surface of the body. For example, the inner body may be formed of nylon and the outer body may be formed of thermoplastic polyurethane molded onto the inner body.

According to one aspect, the outer body is disposed to cover the inner body on the top surface, the bottom surface, the side surfaces, and the second end of the body such that the inner body is exposed only at the first end.

Still further aspects of the disclosure relate to a weight rack comprising a plurality of support beams or other support members, with a the mobility tool as described herein mounted on one of the support members. The mobility tool may have a mounting structure connected to a connection structure of the mobility tool, and the mounting structure is connected to the one of the support members to mount the mobility tool.

Other aspects of the disclosure relate to a method of using a mobility tool as described herein, including mounting the mobility tool on a support beam or other support member and using the tool unassisted, such as by a user pressing a back or other body part into the body of the mobility tool and using weight and/or body force against the body of the tool.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

Figure 1:
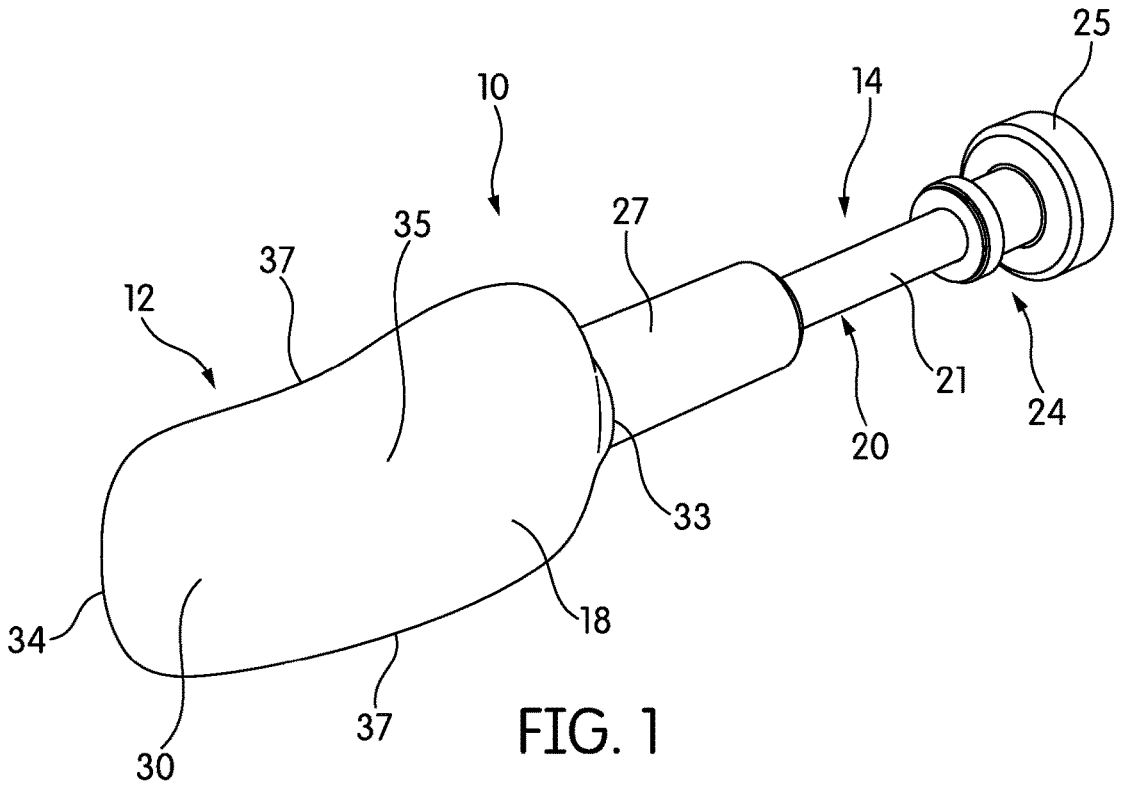
FIG. 1 is a perspective view of one embodiment of a mobility tool according to aspects of the disclosure.
Figure 2:
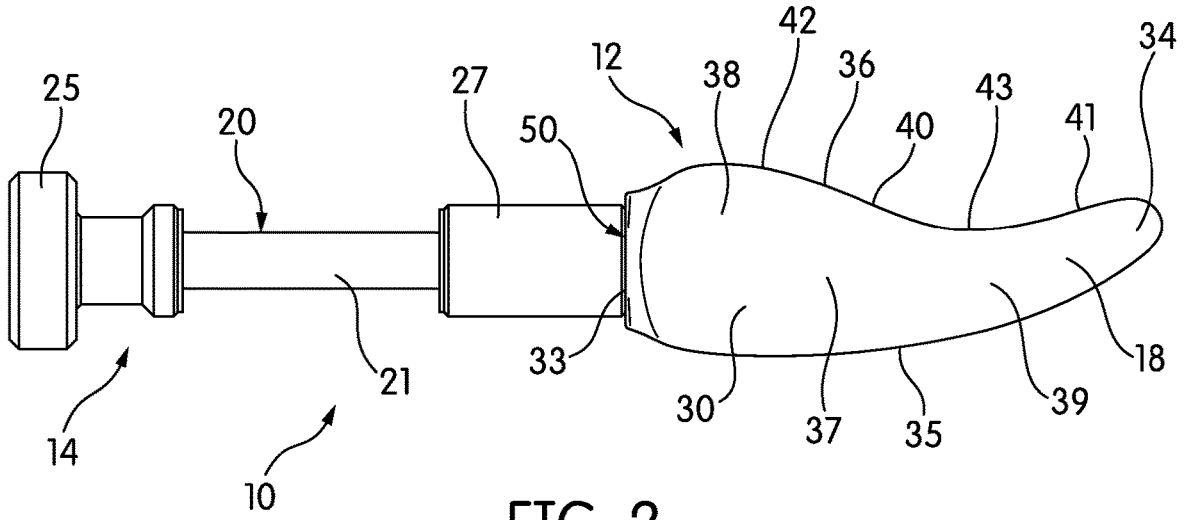
FIG. 2 is a side view of the mobility tool of FIG. 1.

It is understood that these drawings may not be drawn to scale.

DETAILED DESCRIPTION

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 9:
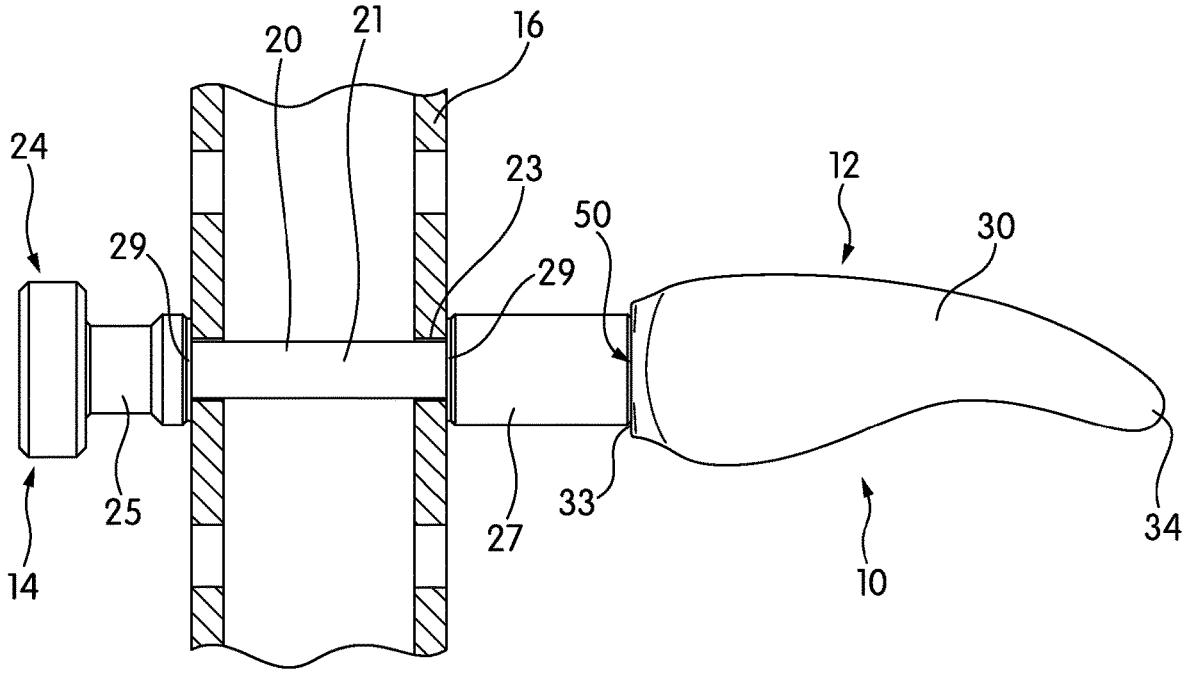
FIG. 9 is a side view of the mobility tool of FIG. 1 mounted on a support beam according to aspects of the disclosure.

FIGS. 1-7 illustrate an example embodiment of a mobility tool 10 according to aspects of the disclosure. The mobility tool 10 in FIGS. 1-7 includes a head 12 configured for engaging a user's body for massage, treatment, and other purposes, which is connected to an external structure 14 that can be used to control the head 12 during use. The external structure 14 in FIGS. 1-7 is configured as a mounting structure 20 that can be connected to a support member 16 as shown in FIG. 9, such as a support beam of a weight rack, to mount the mobility tool 10 on the support member 16. In other embodiments, the external structure 14 may be configured for different functionality, such as a handle for manual use and control of the mobility tool 10 or a mounting structure 20 for a different mounting configuration. It is understood that various different external structures 14 can be used interchangeably with the mobility tool 10.

The head 12 of the mobility tool 10 in FIGS. 1-7 includes a body 30 with a connection structure 50 connected to the body 30 and configured to connect to the external structure 14 (e.g., the mounting structure 20) or a number of different external structures 14 as described above. The connection structure 50 will be described in greater detail below, and the connection structure 50 in FIGS. 1-7 includes a bore 51 with a center axis A in the direction of elongation of the bore 51 (also referred to as a center axis of elongation). The body 30 in one embodiment is designed with a shape, contour, and/or rigidity in order to mimic a human hand, particularly the shape, contour, and rigidity of the human hand when engaged in a massage or therapy activity. The body 30 in FIGS. 1-7 includes an inner body 31 formed of a first material and an outer body 32 formed of a second material that is different from the first material. In particular, the materials of the inner and outer bodies 31, 32 have different hardnesses or flexibilities, and in one embodiment, the material of the inner body 31 is a rigid material, and the material of the outer body 32 is a flexible material having greater flexibility and lower hardness than the rigid material. For example, in one embodiment, the material of the inner body 31 has a hardness in the range of 60-70 Shore D (e.g., 65 Shore D), and the material of the outer body 32 has a hardness in the range of 55-65 Shore A (e.g., 60 Shore A). One example of such a rigid material is nylon or other rigid polymer material (including FRP materials), although other materials may be used, including aluminum or other metals. One example of such a flexible material is thermoplastic polyurethane (TPU), and other medium-hardness polymer materials may be used. The mobility tool 10 in FIGS. 1-7 may be manufactured in one embodiment by molding or otherwise forming the inner body 31 and then subsequently molding the outer body 32 onto the inner body 31, potentially in a co-molding process. As described herein, the body 30 may have a single-material and/or single piece construction in other embodiments, such as the embodiment of FIG. 8 described below.

The body 30 generally has opposed first and second ends 33, 34, which may be considered proximal and distal ends, respectively, relative to the connecting structure 50. The body 30 generally also an outer surface 18 that includes a top surface 35, a bottom surface 36, and side surfaces 37 that extend between the ends 33, 34. The body 30 as shown in FIGS. 1-7 has a somewhat elongated and flattened shape, such that the top and bottom surfaces 35, 36 each have greater surface area than either of the side surfaces 37, and in one embodiment, each of the top and bottom surfaces 35, 36 may have greater surface area than the combined side surfaces 37. The side surfaces 37 in FIGS. 1-7 are generally rounded and elongated between the first and second ends 33, 34. In one embodiment, the body 30 includes a bulbous portion 38 at or proximate the first end 33 and a tongue 39 that extends from the bulbous portion 38 to the second end 34, where the tongue 39 tapers toward the second end 34 such that the tongue has a height H (see FIG. 7) that decreases from the bulbous portion 38 to a minimum height H at the second end 34. The height H of the body 30 is measured between the top and bottom surfaces 35 and is greatest proximate the first end 33, e.g., at the bulbous portion 38, and smallest at the second end 34. In the embodiment of FIGS. 1-7, the height H slightly decreases at a narrowed portion immediately adjacent the first end 33. The top surface 35 in the embodiment of FIGS. 1-7 generally is level or very slightly convex proximate the first end 33 and curves downward in a convex manner toward the second end 34. The bottom surface 36 has contours that may mimic the human hand in one embodiment, as described herein.

Figure 6:
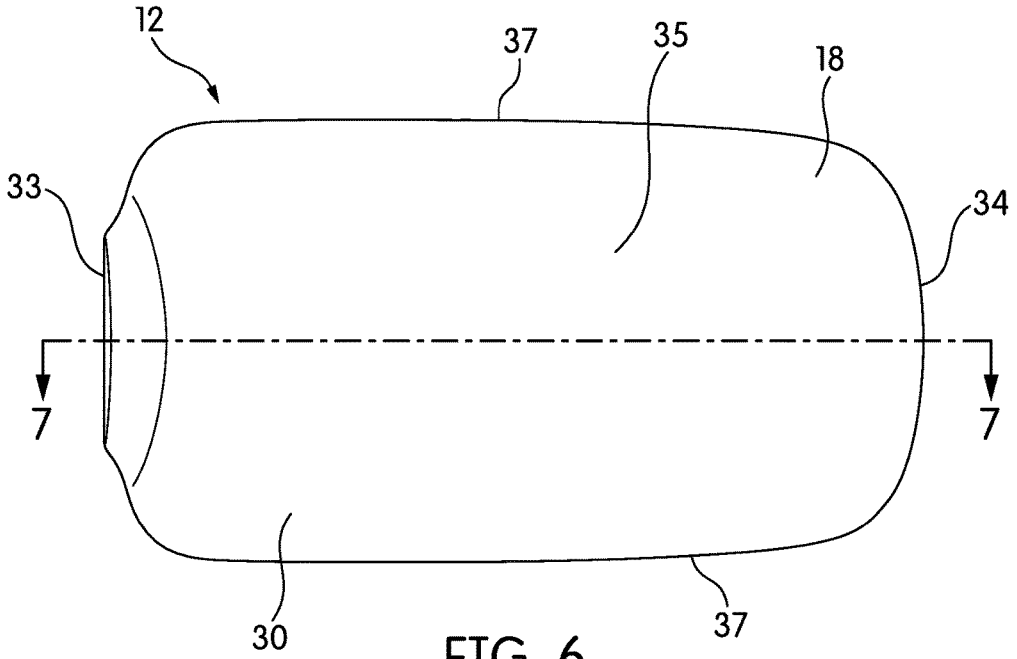
FIG. 6 is a top view of a head of the mobility tool of FIG. 1.
Figure 7:
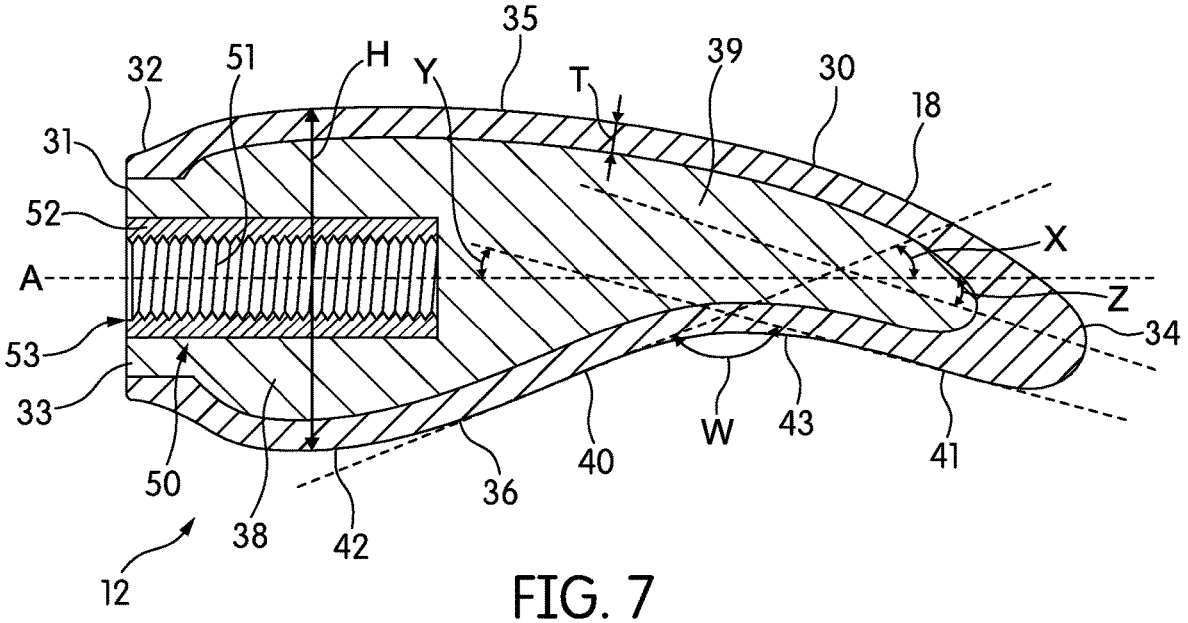
FIG. 7 is a cross-section taken along lines 7-7 of FIG. 6.

The bottom surface 36 of the body 30 in FIGS. 1-7 includes an inclined portion 40 that begins proximate the first end 33 and extends upward toward the second end 34, and a declined portion 41 that extends downward from the inclined portion 40 to the second end 34. The contours of the bottom surface 36 may form smooth and/or curved transitions between the inclined and declined portions 40, 41 themselves and between the inclined and declined portions 40, 41 and adjacent surfaces. The contours of the bottom surface 36 in FIGS. 1-7 include a convex portion 42 proximate the first end 33 and a concave portion 43 proximate the second end 34, with the convex portion 42 forming the transition between the inclined portion 40 and the first end 33 and the convex portion 42 forming the transition between the inclined portion 40 and the declined portion 41. In the embodiment of FIGS. 1-7, the convex portion 42 forms part or all of the bottom side of the bulbous portion 38, and the maximum height H of the body 30 is located at the convex portion 42. The height H as indicated in FIG. 7 is roughly the maximum height H of the body 30 when measured perpendicular to the center axis A. The height H in this embodiment decreases continuously from the point of maximum height H to the second end 34. The concave portion 43 in this embodiment is located on the tongue 39, and the height H of the body 30 at the convex portion 42 is greater than the height H at the concave portion 43. The maximum height H of the body 30 may be at least two times, or at least three times, the minimum height H of the body 30 in one embodiment. The height H of the body at the apex of the convex portion 42 may be at least 1.5 times the height H at the apex of the concave portion 43 in one embodiment, with the "apex" determined by reference to the center axis A as shown in FIG. 7.

Additionally, the orientations of the inclined and declined portions 40, 41 relative to each other and to the other components of the mobility tool 10 may be expressed as angles. The "angle" of a surface such as the inclined and declined portions 40, 41 can be expressed as best-fit lines that follow the surface of the inclined or declined portion 40, 41 and are in the same plane as the lateral centerline of the body 30 (e.g., the center axis A of the bore 51). The "angle" of a volumetric structure such as the downward-curved portion of the tongue 39 can be expressed as a line that passes through a volumetric center of the structure. FIG. 7 illustrates examples of such lines. As shown in FIG. 7, the inclined portion 40 and the declined portion 41 may be oriented at an angle W of 135° to 155° (or approximately 145°) to each other, the inclined portion 40 may be oriented at an angle X of 17° to 27° (or approximately 22°) to the center axis A, and the declined portion 41 may be oriented at an angle Y of 8° to 18° (or approximately 13°) to the center axis A. The downward-curved portion of the tongue 39 in this embodiment may be oriented at an angle Z of 13° to 23° (or approximately 18°) to the center axis A. This contour and shape give the body 30, and in particular the second end 34, a shape that is advantageous for certain massage or treatment techniques and for engaging certain body tissue, including fascia.

Figure 3:
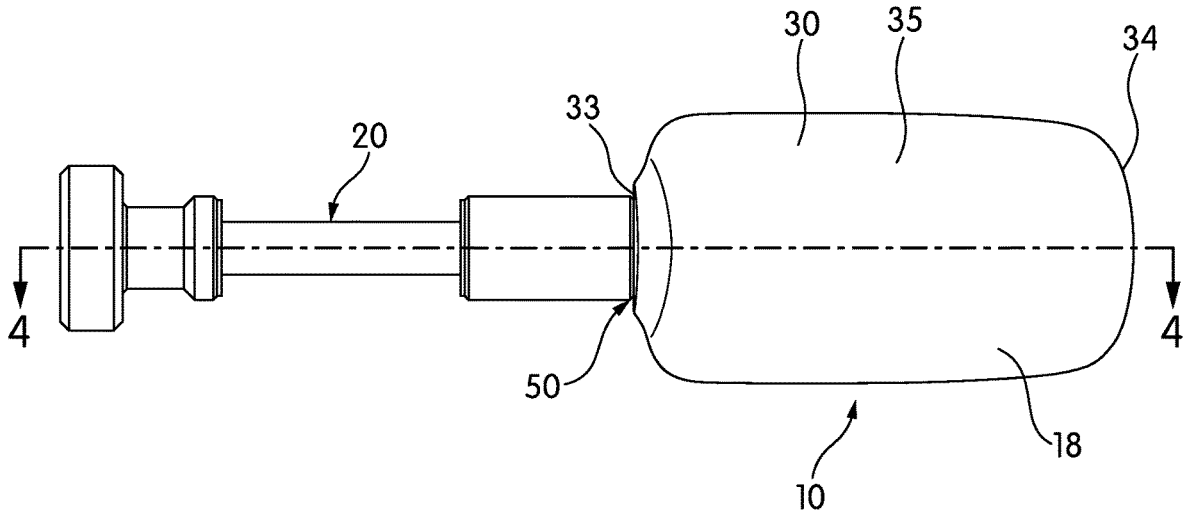
FIG. 3 is a top view of the mobility tool of FIG. 1.
Figure 4:
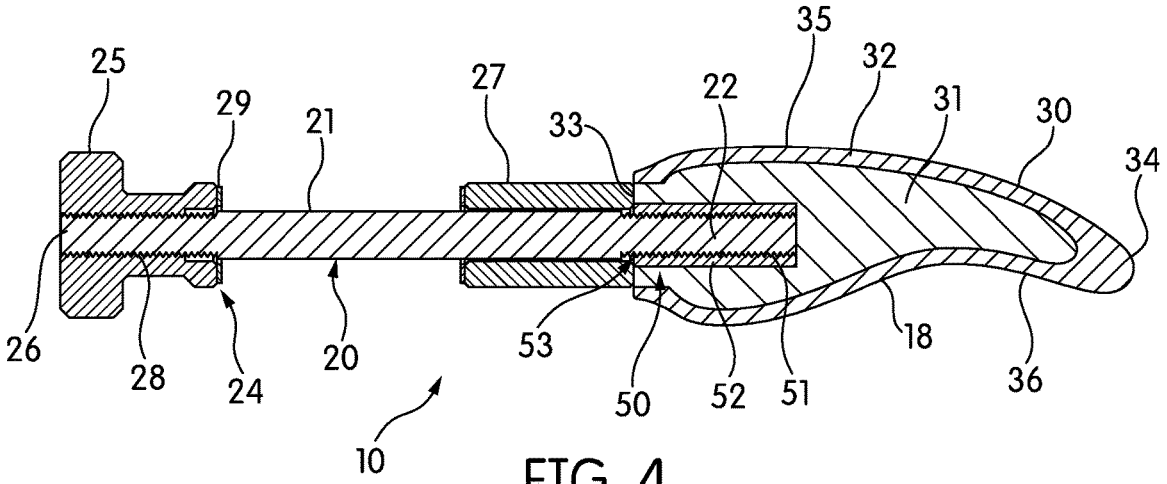
FIG. 4 is a cross-section taken along lines 4-4 of FIG. 3.
Figure 5:
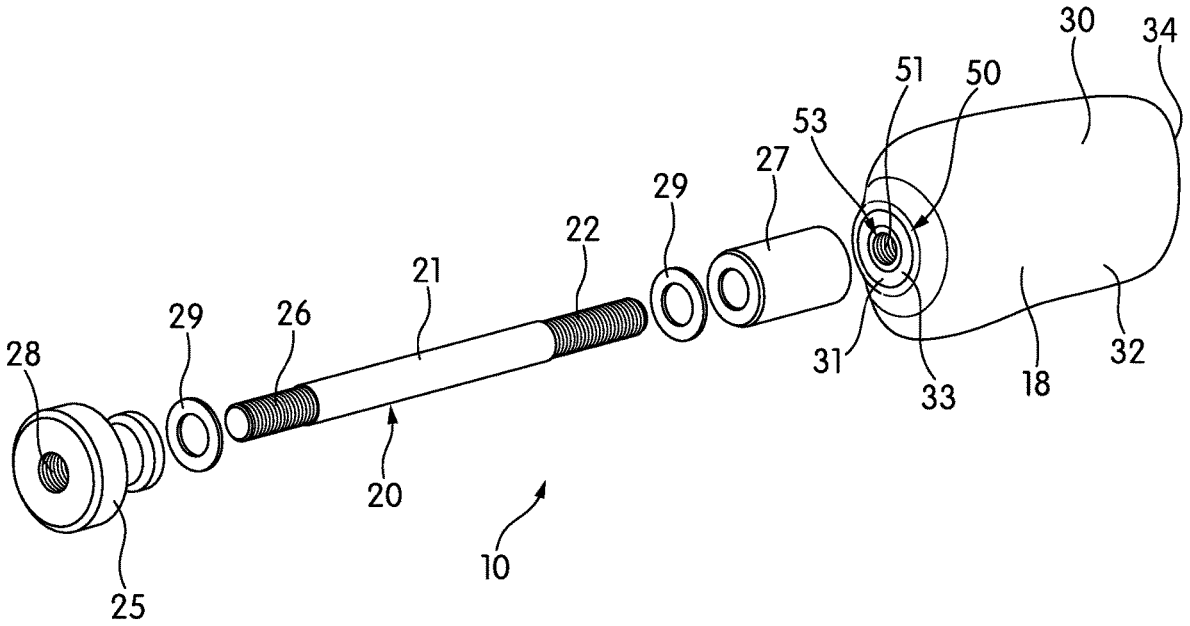
FIG. 5 is an exploded perspective view of the mobility tool of FIG. 1.

The second end 34 of the body 30 is also contoured and shaped advantageous for certain massage or treatment techniques and for engaging certain body tissue, including fascia. The second end 34 is rounded in the embodiment of FIGS. 1-7, and the rounded end 34 in this embodiment has a radius of curvature of 0.20" to 0.40", or approximately 0.30". The rounded second end 34 also has an arc of 145° to 170° in one embodiment. The junctures between the side surfaces 37 and the second end 34 are also rounded when viewed from above or below, as seen in FIGS. 3 and 6. These contours provide both functionality as described herein and comfort during use.

In general, the outer body 32 is engaged with the surface of the inner body 31 and covers at least a portion of the surface of the inner body 31. Additionally, the outer surface 18 of the body 30 in one embodiment is defined by portions of the outer body 32 and the inner body 31. The outer body 32 may cover at least a portion of the top surface 35, the bottom surface 36, and the side surfaces 37 in some embodiments. For example, the outer body 32 may define a majority of the outer surface 18 of the body 30 and/or cover a majority of the surface of the inner body 31 in one embodiment. As another example, the outer body 32 may define at least 75% or at least 90% of the outer surface 18 of the body 30 and/or cover at least 75% or at least 90% of the surface of the inner body 31 in another embodiment. In the embodiment of FIGS. 1-7, the outer body 32 covers the vast majority of the inner body 31 and forms the vast majority of the outer surface 18 of the body 30. In this embodiment, the inner body 31 is exposed and forms part of the outer surface 18 of the body 30 only at the first end 33, and the outer body 32 covers the inner body 31 and forms the entire outer surface 18 of the body on the top surface 35, the bottom surface 36, the side surfaces 37, and the second end 34. The outer body 32 forms a portion of the first end 33 as well in FIGS. 1-7. In further embodiments, the outer body 32 may completely cover the inner body 31 and form the entire outer surface 18 (with the possible exception of a bore 51), or the inner body 31 may cover less than 50% of the outer body 32 and/or form less than 50% of the outer surface 18, such as covering only the portions of the tongue 39 proximate the second end 34.

The thickness T of the outer body 32 may vary (see FIG. 7), and in one embodiment, the thickness T is greatest at the second end 34. For example, the thickness T of the outer body 32 at the second end 34 may be at least two times, or at least three times, the thickness T at other locations on the body 30. In the embodiment of FIGS. 1-7, the thickness T of the outer body 32 at the second end 34 is 0.68" to 0.78" (or approximately 0.73"), and the thickness T of the outer body 32 in other locations is approximately 0.15" to 0.25" (or approximately 0.20"). This increased thickness at the second end 34 assists in comfort and functionality.

The connection structure 50 is generally configured for connection to an external component 14, such as the mounting structure 20 in one embodiment. The connection structure 50 in FIGS. 1-7 includes a bore 51 with a center axis A, where the bore 51 is configured to receive a portion (e.g., an end) of the mounting structure 20. The bore 51 is threaded in one embodiment in order to form a threaded connection with a threaded end 22 of the mounting structure 20, as described in greater detail herein. In FIGS. 1-7, the threading in the bore 51 is provided by a sleeve insert 52 received in the bore 51 with internal threading to create a threaded bore 51. The bore 51 extends to the outer surface 18 of the body 30 to form an opening 53 for insertion of the connecting portion of the external component 14. Additionally, the connection structure 50 in FIGS. 1-7 is positioned at the first end 33 of the body 30 and configured for engagement of the external component 14 at the first end 33. The first end 33 of the body 30 is relatively flattened in this embodiment, in order to facilitate engagement with the mounting structure 20. The mobility tool 10 may include additional connection structure 50 in one embodiment, such as a second bore 51 or other connection structure 50 configured for connection to an external component 14 in a different orientation and/or location. For example, the body 30 may include a second bore 51 on the bottom surface 36, such as within the bulbous portion 38, that is oriented at 90° or another transverse angle to the central axis A. Further, in the embodiment of FIGS. 1-7, the bore 51 is defined exclusively within the inner body 31 and the opening 53 is formed in the first end 33 in the inner body 31, such that the external component 14 engages only the inner body 31. Any additional bores 51 or other connection structure 50 as described herein may be similarly configured for engagement with the inner body 31.

In other embodiments, a different connection structure 50 may be used. As one example, the bore 51 may be smooth and/or the connection structure 50 may include a different type of retaining structure, including tabs, fasteners, adhesive, etc. In one embodiment, a connection structure 50 with a smooth bore 51 may be used to place the mobility tool 10 on the end of a barbell for ease of use in a gym setting where a mounting structure 20 is not provided. As another example, a connection structure 50 without a bore 51 may be used, for example, an external structure such as a clamp, buckle, lock, post, etc. It is understood that the head 12 may be used as a mobility tool 10 without connection to any external component 14, and that the head 12 may not have any connection structure 50 in one embodiment.

The mounting structure 20 in FIGS. 1-7 is configured for connection to a support member 16, such as a support beam of a weight rack, to mount the mobility tool 10 on the support member 16, as shown in FIG. 9. In one embodiment, the mounting structure 20 includes a shaft 21 with an end 22 that is configured to engage the connection structure 50, where the shaft 21 is configured to be received into and/or through a passage 23 in the support member 16 to mount the mobility tool 10 on the support member 16. The end 22 in FIGS. 1-7 is a threaded end 22 configured to engage the threaded bore 51 by threading, as described herein. The central portion of the shaft 21 is smooth in FIGS. 1-7, and is intended to be received in the passage 23 as shown in FIG. 9. The mounting structure 20 may also include retaining structure 24 to retain the mounting structure 20 in engagement with the support member 16 and/or to tighten the connections between these components. In the embodiment of FIGS. 1-7, the retaining structure 24 includes a retaining member 25 for connection to a second end 26 of the shaft 21 and a bushing 27 for abutting engagement with the support member 16 and/or the head 12. In this configuration, the retaining member 24 and the bushing 27 abuttingly engage opposed surfaces of the support member 16, and the bushing 27 is abuttingly engaged on opposed ends by the support member 16 and the first end 33 of the body 30. The retaining member 25 in FIGS. 1-7 is in the form of a threaded cap that has a threaded bore 28 for threading onto the second end 26 of the shaft 21 (which is also threaded). Other retaining members 25 may be used in other embodiments, and it is understood that the shaft 21 may be configured for engagement with such retaining members 25. The bushing 27 also receives a portion of the shaft 21, and may be provided with structure to retain the bushing 27 in position with respect to the shaft 21 (e.g., internal threading) in one embodiment. Spacers 29 such as washers may further be used, such as for direct engagement of the surfaces of the support member 16.

Mounting of the mobility tool 10 as shown in FIG. 9 may be accomplished by threading the head 12 onto the first end 33 of the shaft 21 of the mounting structure 20, then inserting the second end 26 of the shaft 21 through the passage 23 in the support member 16 such that the bushing 27 is positioned between the head 12 and the support member 16, then threading the retaining member 25 onto the second end 26 of the shaft 21 until the connection is tight and secure. It is understood that the mobility tool 10 may be mounted at different heights and orientations for desired use, and in one embodiment, may be mounted at a height and orientation so that a user can push his/her back against the second end 34 of the body 30, using body weight and the force of gravity for assistance with accessing fascia or other deep/inaccessible tissues. Disconnection and/or disassembly of the mobility tool 10 may be accomplished in reverse order.

Figure 8:
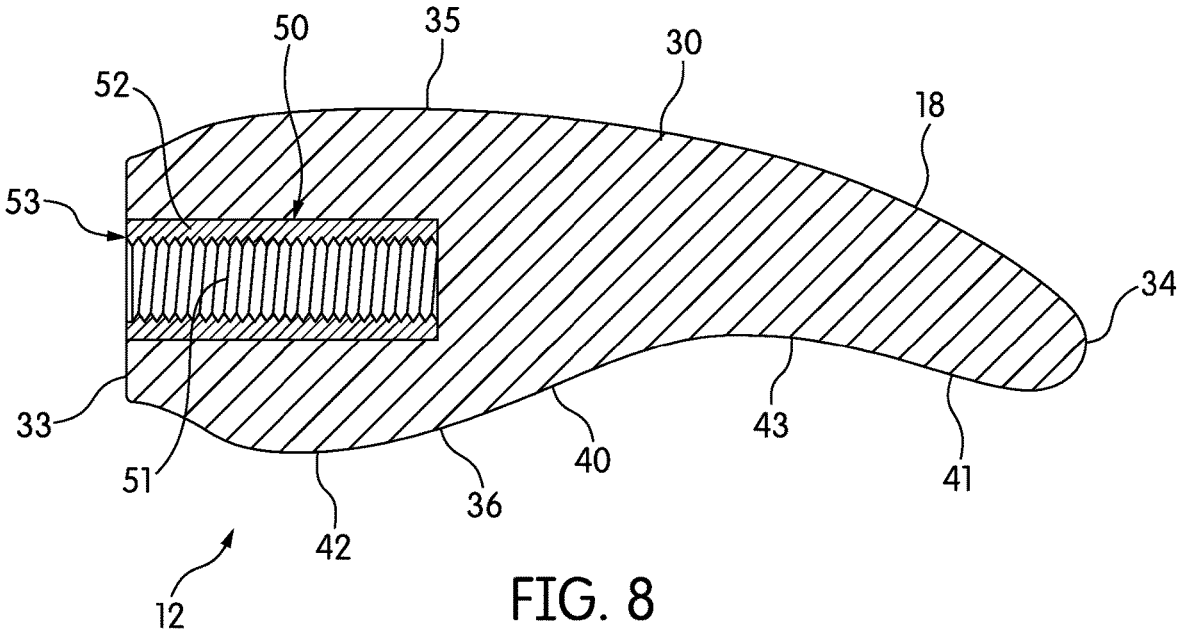
FIG. 8 is a cross-section view of another embodiment of a mobility tool according to aspects of the disclosure.

FIG. 8 illustrates another embodiment of a mobility tool 10 according to aspects of the disclosure. The mobility tool 10 in FIG. 8 includes many components and features in common with the mobility tool 10 in FIGS. 1-7, and these components and features are not re-described herein for the sake of brevity. In particular, the mobility tool 10 in FIG. 8 has the same size and external shape as the mobility tool 10 in FIGS. 1-7, as well as the same connection structure 50. The mobility tool 10 in FIG. 8 does not include both an inner body and an outer body as described herein with respect to FIGS. 1-7, and instead, the mobility tool in FIG. 8 is made from a single material, which may be a single molded piece. The material of the mobility tool in FIG. 8 may be the same material used for the outer body 32 described herein with respect to FIGS. 1-7 (e.g., solid TPU), or may be a different material. For example, the material of the mobility tool in FIG. 8 may have a higher hardness than the material for outer body 32 described herein but lower hardness than the material for the inner body 31 described herein. Other components and features described herein, including any variations or alternate embodiments, may be incorporated into the embodiment of FIG. 8.

Various components and features have been described herein with respect to different embodiments of the mobility tool 10, including variations and modifications to the embodiments illustrated in the drawing figures. It is understood that any combination of such components and features, including such variations and modifications, may be used in accordance with embodiments of the disclosure.

The embodiments of mobility tools 10 described herein provide benefits and advantages over existing mobility tools and similar devices. For example, the mobility tools 10 described herein can be quickly and easily mounted on a weight rack or other athletic equipment in a fixed position, providing the ability for a user to use the mobility tool 10 unassisted or with limited assistance. As another example, the mobility tools 10 described herein have a shape, contour, and rigidity that are particularly useful for accessing fascia and other tissues that are inaccessible for various reasons, including their depth and/or location relative to other tissue. As a further example, the mobility tools 10 described herein provide for use in a variety of different configurations. Other benefits and advantages are recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way unless specified with reference to a specific orientation or feature. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A mobility tool comprising:

a body having first and second opposed ends and an outer surface including a top surface, a bottom surface, and side surfaces extending between the first and second ends, wherein the top and bottom surfaces have greater surface area than the side surfaces, wherein the bottom surface has a contour that includes a convex portion proximate the first end and a concave portion proximate the second end, and wherein a height of the body measured between the top and bottom surfaces is greater at the convex portion than the concave portion, and the height is smallest at the second end, the body further comprising:

an inner body formed of a rigid material; and an outer body formed of a flexible material having greater flexibility than the rigid material, wherein the outer body is disposed to cover the inner body on the top surface, the bottom surface, the side surfaces, and the second end of the body such that the inner body is exposed only at the first end, such that the outer body defines the contour of the bottom surface, wherein the inner body has a second contour that includes a second convex portion located inward from the convex portion of the bottom surface and a concave portion located inward from the concave portion of the bottom surface; and a connection structure at the first end of the body, wherein the connection structure is configured for connection to a mounting structure.

2. The mobility tool of claim 1, further comprising the mounting structure, wherein the mounting structure comprises a shaft configured to be received through a passage in a support beam to mount the mobility tool on the support beam, the shaft having a connection end connected to the connection structure of the body.

3. The mobility tool of claim 2, wherein the mounting structure further comprises a retaining member configured to retain the shaft within the passage in the support beam.

4. The mobility tool of claim 3, wherein the retaining member is a cap connected by threading onto the shaft opposite the connection end, and the mounting structure further comprises a bushing disposed around the shaft and engaging the first end of the body, such that the cap and the bushing are configured to engage opposite sides of the support beam when the mounting structure is connected to the support beam.

5. The mobility tool of claim 1, wherein the outer body has a thickness that is greatest at the second end.

6. The mobility tool of claim 5, wherein the thickness of the outer body is more than two times greater at the second end than at other locations on the body.

7. The mobility tool of claim 1, wherein the connection structure comprises a threaded bore extending inwardly into the inner body from the first end of the body.

8. The mobility tool of claim 1, wherein the connection structure comprises a threaded steel sleeve insert received within the inner body at the first end of the body and defining a threaded bore extending inwardly from the first end of the body.

9. The mobility tool of claim 1, wherein the inner body is formed of nylon and the outer body is formed of thermoplastic polyurethane molded onto the inner body.

10. The mobility tool of claim 1, wherein the second end of the body has a radius of curvature of 0.20-0.40 inches.

11. The mobility tool of claim 1, wherein the rigid material of the inner body has a hardness of 60 to 70 Shore D and the flexible material of the outer body has a hardness of 55 to 65 Shore A.

12. A weight rack comprising a plurality of support members and the mobility tool of claim 1 mounted on one of the support members, wherein the mobility tool further comprises the mounting structure connected to the connection structure, and the mounting structure is connected to the one of the support members to mount the mobility tool.

13. A mobility tool comprising:

a body having first and second opposed ends and an outer surface formed of a flexible material, the outer surface including a top surface, a bottom surface, and side surfaces extending between the first and second ends, wherein the top and bottom surfaces have greater surface area than the side surfaces, wherein the top surface is curved toward the bottom surface, and the bottom surface has a contour that includes a convex portion proximate the first end, an inclined portion extending from the convex portion toward the second end, a declined portion proximate the second end, and a concave portion forming a transition between the inclined portion and the declined portion, wherein the declined portion extends from the concave portion to the second end, and wherein a height of the body measured between the top and bottom surfaces is greatest at an area of greatest height located at an apex of the convex portion and decreases from the area of greatest height to the second end, such that the height at the area of greatest height is at least 1.5 times the height at an apex of the concave portion, and the height is smallest at the second end and the body tapers toward the second end.

14. The mobility tool of claim 13, wherein the flexible material is a thermoplastic polyurethane material having a hardness of 55 to 65 Shore A.

15. The mobility tool of claim 13, wherein the body comprises a bulbous portion proximate the first end and a tongue extending from the bulbous portion to the second end, wherein the concave portion, the declined portion, and at least a portion of the inclined portion are part of the tongue, and wherein the height of the body decreases from the bulbous portion to the second end.

16. The mobility tool of claim 13, further comprising a passage extending inwardly from the first end of the body, the passage having a center axis of elongation, wherein the declined portion forms an angle with the center axis of elongation of 8° to 18°.

17. The mobility tool of claim 13, wherein the side surfaces are rounded and elongated between the first and second ends.

18. The mobility tool of claim 13, wherein the second end of the body has a radius of curvature of 0.20-0.40 inches.

19. A weight rack comprising a plurality of support members and the mobility tool of claim 13 mounted on one of the support members, wherein the mobility tool further comprises a mounting structure connected to the first end of the body, and the mounting structure is connected to the one of the support members to mount the mobility tool.

20. A mobility tool comprising:

a body having first and second opposed ends and an outer surface including a top surface, a bottom surface, and side surfaces extending between the first and second ends, wherein the body tapers to the second end such that a height of the body measured between the top and bottom surfaces is smallest at the second end, the body further comprising:

an inner body formed of a rigid material; and an outer body formed of a flexible material having greater flexibility than the rigid material, wherein the outer body is disposed to cover the inner body on at least a portion of the top surface, at least a portion of the bottom surface, and at least a portion of the side surfaces, the outer body further disposed to cover the inner body on the second end of the body and to form a majority of the outer surface of the body; and a bore extending inwardly into the inner body at the first end, the bore configured for receiving an end of a shaft configured for mounting the mobility tool on a support beam.

21. The mobility tool of claim 20, wherein the body comprises a bulbous portion proximate the first end and a tongue extending from the bulbous portion to the second end, wherein the tongue has a bottom surface that comprises an inclined portion, a declined portion, and a concave portion forming a transition between the inclined portion and the declined portion, and wherein the height of the body decreases from the bulbous portion to the second end.

22. The mobility tool of claim 20, wherein the outer body is disposed to cover the inner body on the top surface, the bottom surface, the side surfaces, and the second end of the body such that the inner body is exposed only at the first end.

23. The mobility tool of claim 20, wherein the second end of the body has a radius of curvature of 0.20-0.40 inches.

24. The mobility tool of claim 20, wherein the inner body is formed of nylon and the outer body is formed of thermoplastic polyurethane molded onto the inner body.

25. A weight rack comprising a plurality of support members and the mobility tool of claim 20 mounted on one of the support members, wherein the mobility tool further comprises a mounting structure including the shaft connected to the first end of the body, and the mounting structure is connected to the one of the support members to mount the mobility tool.

26. The mobility tool of claim 20, wherein the bore is a threaded bore.

27. The mobility tool of claim 26, further comprising a threaded sleeve insert received within the inner body at the first end of the body and defining the threaded bore.

* * * * *